United States Patent [19]

McGuire

[11] Patent Number: 4,586,751

[45] Date of Patent: May 6, 1986

[54] METHOD OF ASSEMBLING RATTAN FURNITURE

[75] Inventor: John C. McGuire, San Francisco, Calif.

[73] Assignee: The McGuire Company of San Francisco, San Francisco, Calif.

[21] Appl. No.: 670,953

[22] Filed: Nov. 13, 1984

[51] Int. Cl.[4] ..... A47C 7/00

[52] U.S. Cl. ..... 297/445; 144/271; 144/331; 144/380; 144/381; 297/460; 297/463

[58] Field of Search ..... 69/21; 144/271, 380, 144/381, 359, 329, 333, 353; 297/445, 460, 463; D6/51, 57

[56] References Cited

U.S. PATENT DOCUMENTS

| | | | |
|---|---|---|---|
| 228,377 | 6/1880 | Newton | 144/333 |
| 412,737 | 10/1889 | Ehrich | 144/333 |
| 3,867,967 | 2/1975 | Rocchia et al. | 297/445 |

*Primary Examiner*—W. D. Bray

*Attorney, Agent, or Firm*—Limbach, Limbach & Sutton

[57] ABSTRACT

The subject invention relates to an improved method of assembling rattan furniture. More particularly, a method is disclosed for fabricating a composite rattan piece having an effective diameter sufficient to form a rigid structure. In accordance with the subject invention, a plurality of relatively smaller diameter rattan segments are steam heated until deformable. These segments are then helically wound to define a larger diameter piece. The piece is cooled and shaped into the desired configuration to define a rigid support member which can be used to assemble furniture.

11 Claims, 5 Drawing Figures

METHOD OF ASSEMBLING RATTAN FURNITURE

DESCRIPTION

1. Technical Field

The subject invention relates to a new and improved method of assembling rattan furniture. More particularly, a method is disclosed wherein individual segments of rattan are wound in a helical configuration to define a composite piece having greater structural rigidity. These composite pieces are used for fabricating rattan furniture.

2. Background Art

Rattan has been used to fabricate furniture for many years. Rattan is a jungle vine which grows in lengths up to several hundred feet long. Rattan is solid and is made up of longitudinal fibers. It is valued for its strength, yet when heated and steamed it becomes flexible, facilitating its use in assembling furniture.

Rattan grows in two principal areas of the world, the Philippines and Indonesia. In these areas it grows deep in the jungles and is difficult to harvest. Until recently it was quite common to harvest larger diameter rattan poles which were relatively sturdy and could be used to manufacture the desired scale furniture. These structural pieces typically had diameters ranging from $1\frac{1}{2}$ inches to $1\frac{5}{8}$ inches.

Recently, however, heavier gauge rattan segments have become scarce. A number of reasons have contributed to this shortage. For example, the heavier pieces of rattan are found in the deepest recesses of the jungle, making it most difficult to harvest. In addition, anti-government resistance recently has made the harvesting and export of the larger rattan pieces more difficult.

With the heavier gauge rattan pieces less available, it has been necessary to build furniture using relatively thinner segments, having diameters ranging from one-half inch to one inch. Unfortunately, these thinner segments could not provide the structural support or aesthetic beauty which is associated with the heavier gauge rattan segments.

Accordingly, it is an object of the subject invention to provide a new and improved method of assembling rattan furniture which utilizes relatively thinner diameter rattan segments, yet having the advantages of the thicker diameter pieces.

It is another object of the subject invention to provide a new and improved method for fashioning composite rattan segments having an effective diameter greater than $1\frac{1}{2}$ inches.

A further object of the subject invention is to provide improved furniture formed from composite rattan segments, each of which have a diameter less than an inch but having an effective diameter greater than $1\frac{1}{2}$ inches.

SUMMARY OF THE INVENTION

In accordance with these and many other objects, the subject invention defines a new and improved method of fabricating larger diameter pieces of rattan from smaller diameter segments. The larger diameter piece may then, in turn, be used to form elements of rattan furniture.

In accordance with the subject method, a plurality of smaller diameter rattan segments are steam heated. The rattan segments that are typically available today range between one-half and an inch in diameter. These segments are heated until they become deformable. A plurality of these segments can then be wound into a helical configuration, to define a rattan piece having a larger effective diameter than any of the individual segments alone. When the composite helical piece is cooled, it forms a rigid member suitable for constructing furniture.

In the preferred embodiment, the ends of the rattan segments are bound with rawhide to ensure that composite helical structure remains tightly wound. The piece may then be formed into the desired curvature using the techniques previously employed when handling larger diameter rattan. These shaping techniques will be described in more detail below. The composite piece and any additional thinner segments can then be assembled into furniture. Techniques for assembling rattan are described in applicant's prior U.S. Pat. No. 2,936,009, issued May 10, 1960, and U.S. Pat. No. 3,297,063, issued Jan. 10, 1967, incorporated herein by reference.

Furniture formed in accordance with the subject invention has all the structural advantages of rattan assemblies which utilize heavier gauge pieces. Accordingly, the subject method allows superior quality to be maintained while working with less than desirable raw materials.

Further objects of the subject invention will become apparent from the following detailed description taken in conjunction with the drawings in which:

DETAILED DESCRIPTION OF THE PREFERRED EMBODIMENT

As set forth above, rattan is a jungle vine formed from densely packed longitudinal fibers. When harvested in the jungle it is typically cut into fourteen foot lengths. Until recently, relatively heavy gauge segments could be harvested having a diameter ranging from $1\frac{1}{2}$ to $1\frac{5}{8}$ inches. However, recent circumstances have reduced the effectiveness of the harvest, such that the supply of larger diameter pieces has sharply diminished. These heavier gauge pieces were primarily used as load-bearing structures in sturdy furniture. Their decreased availability has made it difficult to design high quality, sturdy furniture, of the scale desired.

The subject invention is intended to overcome these difficulties. More particularly, applicant's invention defines a method for assembling rattan pieces having an effective diameter on the order of $1\frac{1}{2}$ inches and up. These composite pieces are formed from segments of rattan having a relatively smaller diameter on the order of ½ inch to 1 inch. The latter size segments are more readily available and can be harvested with more uniformity.

Figure 1:
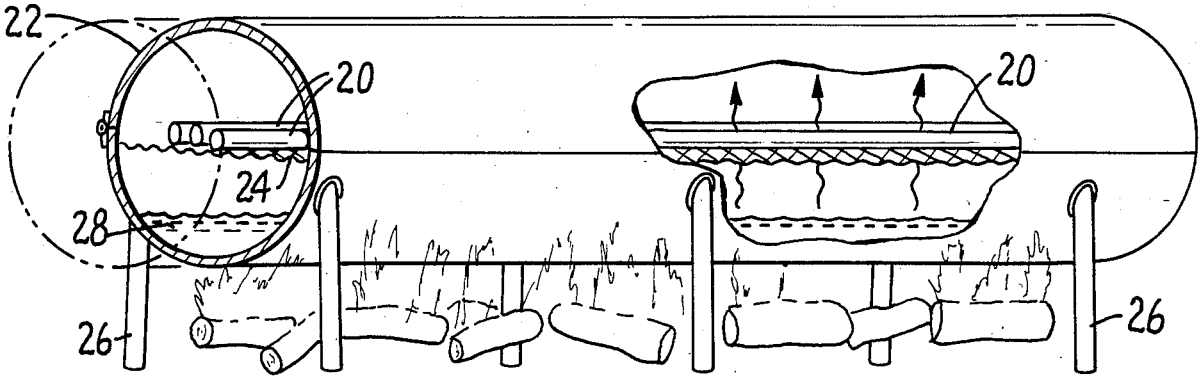
FIG. 1 is a perspective view of a heating and steam oven typically used in the steps used in preparing rattan pieces.

Referring to FIG. 1, the first step in the method of the subject invention is illustrated. More specifically, in the first step of the subject invention, relatively smaller diameter pieces 20 are heated and steamed. FIG. 1 illustrates a cylindrical oven 22. A wire mesh grating 24 is placed within the oven for supporting the pieces of rattan. The assembly is supported on stands 26 over a heat source 27, such as a fire. Preferably, water 28 is introduced into the furnace to create steam. The hot steam permeates the fibers of the rattan, making it flexible or deformable. The steam also permits the rattan to be heated for a longer period of time without burning. The length of heating is dependent upon the thickness of the rattan.

Once the rattan is sufficiently flexible, it is removed from the oven. In the prior art, the rattan would then be shaped into the desired configuration for assembling furniture. In the subject invention, the relatively thinner rattan pieces 22 are formed into a composite structure of greater diameter.

Figure 2:
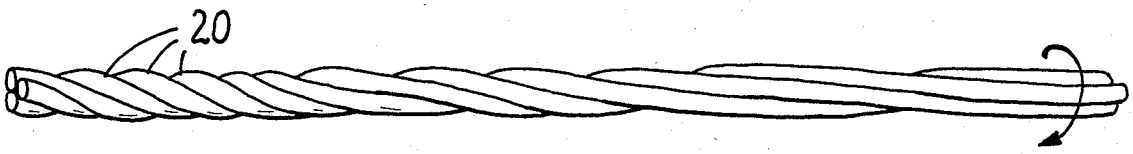
FIG. 2 is a perspective view illustrating an intermediate step in forming a composite, helical rattan piece of the subject invention.
Figure 3:
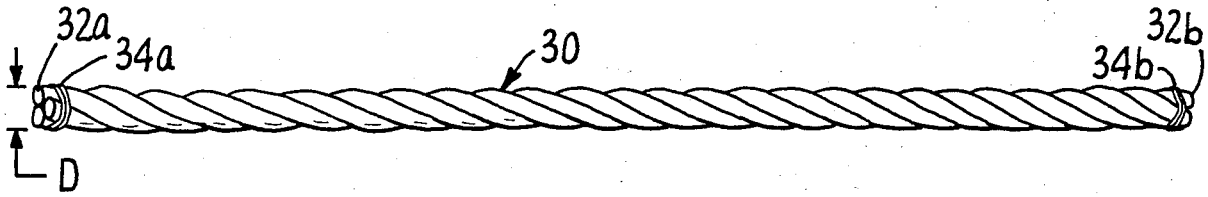
FIG. 3 is a perspective view illustrating a composite helically wound piece of rattan formed in accordance with the method of the subject invention.

Referring to FIGS. 2 and 3, the latter steps are illustrated. More specifically, and as shown in FIG. 2, a plurality of segments 20 of rattan are wound into a helical configuration. The number of segments used to form the composite may be varied, however, good success has been achieved using three segments. In order to enhance rigidity, it is desirable to wind the helix relatively tightly. This winding step has been performed by hand, although it is within the scope of the subject invention to perform such winding by machine.

When the twisting has been completed, the opposed free ends 32*a* and 32*b* of the composite piece 30 are screwed together and then wrapped with rawhide strips 34*a* and 34*b*. The use of rawhide strips to bind rattan members is described in applicant's prior patents cited above. Typically, the rawhide is soaked with a liquid prior to binding. By this arrangement, the rawhide strip will shrink upon drying, thereby tightening its grip to maintain a secure structure. Where rattan segments having a diameter of ½ inch to 1 inch are utilized, a composite helical structure 30 can be formed having an effective diameter D, in the range of 1½ to 3 inches.

Figure 4:
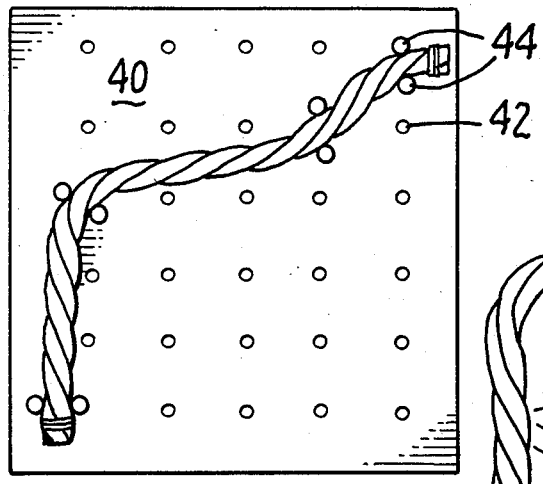
FIG. 4 is a perspective view of an assembly tool used for deforming a piece of rattan into a desired configuration.

After the flexible rattan segments have been wound and bound, they are preferably formed into the design curvature of the furniture. There are a number of techniques which can be utilized to carry out this step. An apparatus for implementing one of these techniques is illustrated in FIG. 4. More particularly, FIG. 4 illustrates a frame 40 having a plurality of apertures 42 arranged in a matrix. The apertures are designed to receive various pegs or stops 44. During the assembly, the flexible piece of composite rattan is bent around and about the pegs 44. When the rattan dries and cools it forms a rigid member having the desired curvature. The frame shown in FIG. 4 is suitable for constructing shapes that are planar. Where the rattan is to be formed into a three-dimensional shape, a cage-like frame (not shown) is utilized.

Figure 5:
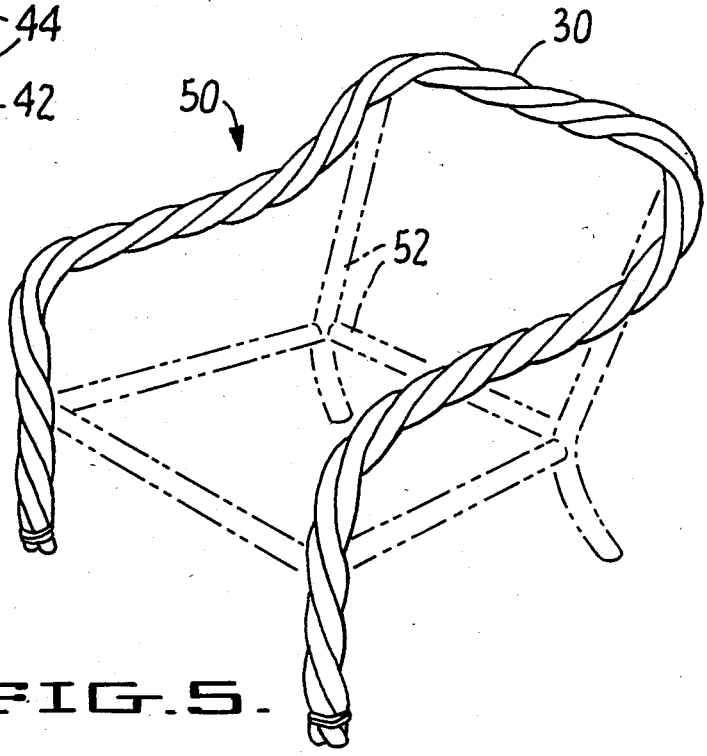
FIG. 5 is a perspective view of a piece of furniture where a composite piece of rattan formed in accordance with the subject invention (shown in solid line) is utilized.

Once the composite helical structure has cooled to define a rigid structure, it is used as a structural element in furniture. FIG. 5 illustrates a chair 50 which has been formed using a piece of composite rattan 30. Relatively thinner segments of rattan 52 (shown in phantom) may be assembled with the heavier gauge composite 30 using the construction techniques described in applicant's prior patents. The joints between the rattan members can be either coped or doweled and thereafter glued and screwed. To facilitate shaping of the composite piece, slight curvature adjustments can be made by applying direct heat at the point to be deformed. The direct heat can be supplied by a blowtorch or other similar device. The resulting assembly has enhanced structural rigidity due to the composite helical load-supporting pieces 30.

In summary, there has been provided a new and improved method of creating rattan furniture. In this method, rigid rattan pieces having a large effective diameter are formed from a plurality of smaller rattan segments. In accordance with the subject invention, the smaller rattan segments are wrapped into a helical configuration to define a rigid load-bearing piece.

While the subject invention has been described with reference to a preferred embodiment, it will be apparent that other changes and modifications could be made by one skilled in the art without varying from the scope and spirit of the subject invention as defined by the appended claims.

I claim:

1. A method of fabricating a larger diameter piece of rattan from smaller diameter rattan segments comprising the steps of:

heating a plurality of smaller diameter rattan segments until each piece is deformable;

twisting the rattan segments in a manner to define a composite helical piece having a larger effective diameter than the individual segments; and cooling the larger diameter piece such that a rigid member is produced suitable for constructing furniture.

2. A method as recited in claim 1 wherein during said heating stop, the smaller diameter rattan segments are steamed.

3. A method as recited in claim 1 wherein after said twisting step is completed, the opposed free ends of the composite helical piece are bound with rawhide.

4. A method as recited in claim 1 wherein said smaller diameter rattan segments have a diameter less than one inch.

5. An improved method of assembling rattan furniture including the steps of:

providing a plurality of rattan segments, each having a diameter less than one inch;

heating said rattan segments until each is deformable;

twisting the segments in a manner to define a composite helical piece having an effective diameter greater than one and one-half inches;

bending and securing the composite piece into the desired curvature to define an element of the piece of furniture; and cooling the piece such that a rigid member is produced of the desired curvature.

6. A method as recited in claim 5 wherein during said heating step, the smaller diameter rattan segments are steamed.

7. A method as recited in claim 5 wherein after said twisting step is completed, the opposed free ends of the composite helical piece are bound with rawhide.

8. A method as recited in claim 5 wherein after said cooling step, the rigid composite member may be further shaped by applying heat to any area which must be further deformed.

9. Improved furniture having elements formed from rattan, wherein the improvement comprises:

a composite rattan piece having an effective diameter greater than one and one-half inches, said composite piece being formed from a plurality of rattan segments, each having a diameter of less than one inch, with said rattan segments being twisted into a composite helical piece for added strength.

10. Improved furniture as recited in claim 9 wherein said opposed free ends of the composite helical piece are bound with rawhide.

11. Improved furniture as recited in claim 9 wherein three rattan segments are used to form said composite helical piece.

* * * * *

US004586751B1

REEXAMINATION CERTIFICATE (2048th)

United States Patent [19]

McGuire

[11] B1 4,586,751

[45] Certificate Issued Jun. 29, 1993

[54] METHOD OF ASSEMBLING RATTAN FURNITURE

[75] Inventor: John C. McGuire, San Francisco, Calif.

[73] Assignee: The McGuire Furniture Company, San Francisco, Calif.

Reexamination Request:
No. 90/002,714, May 6, 1992

Reexamination Certificate for:

| | |
|---|---|
| Patent No.: | 4,586,751 |
| Issued: | May 6, 1986 |
| Appl. No.: | 670,953 |
| Filed: | Nov. 13, 1984 |

[51] Int. Cl.[5] ..... A47C 7/00; B27J 7/00

[52] U.S. Cl. ..... 297/445; D6/369; 144/271; 144/333; 144/380; 144/381; 144/331; 297/460; 297/463

[58] Field of Search ..... 144/259, 271, 329, 333, 144/353, 359, 361, 364, 380, 381; 139/424; 297/445, 460, 463; D6/369

[56] References Cited

U.S. PATENT DOCUMENTS

| | | | |
|---|---|---|---|
| 225,160 | 3/1880 | Ordway . | |
| 247,269 | 9/1881 | Ordway . | |
| 281,124 | 7/1883 | Ordway . | |
| 329,479 | 11/1885 | Ordway . | |
| 329,480 | 11/1885 | Ordway . | |
| 344,675 | 6/1886 | Ordway . | |
| 371,700 | 10/1887 | Ordway . | |
| 498,140 | 5/1893 | Ordway . | |
| 595,199 | 12/1897 | Ordway . | |
| 603,965 | 5/1898 | Ordway . | |
| 635,179 | 10/1899 | Ordway . | |
| 637,652 | 11/1899 | Ordway . | |
| 650,269 | 5/1900 | Ordway . | |
| 655,889 | 8/1900 | Ordway . | |
| 656,040 | 8/1900 | Ordway . | |
| 821,055 | 5/1906 | Ordway . | |
| 887,959 | 5/1908 | Ordway . | |
| 926,821 | 7/1909 | Ordway . | |
| 1,007,006 | 10/1911 | Ordway . | |
| 3,297,063 | 1/1967 | McGuire | 144/353 |

*Primary Examiner*—W. Donald Bray

[57] ABSTRACT

The subject invention relates to an improved method of assembling rattan furniture. More particularly, a method is disclosed for fabricating a composite rattan piece having an effective diameter sufficient to form a rigid structure. In accordance with the subject invention, a plurality of relatively smaller diameter rattan segments are steam heated until deformable. These segments are then helically wound to define a larger diameter piece. The piece is cooled and shaped into the desired configuration to define a rigid support member which can be used to assemble furniture.

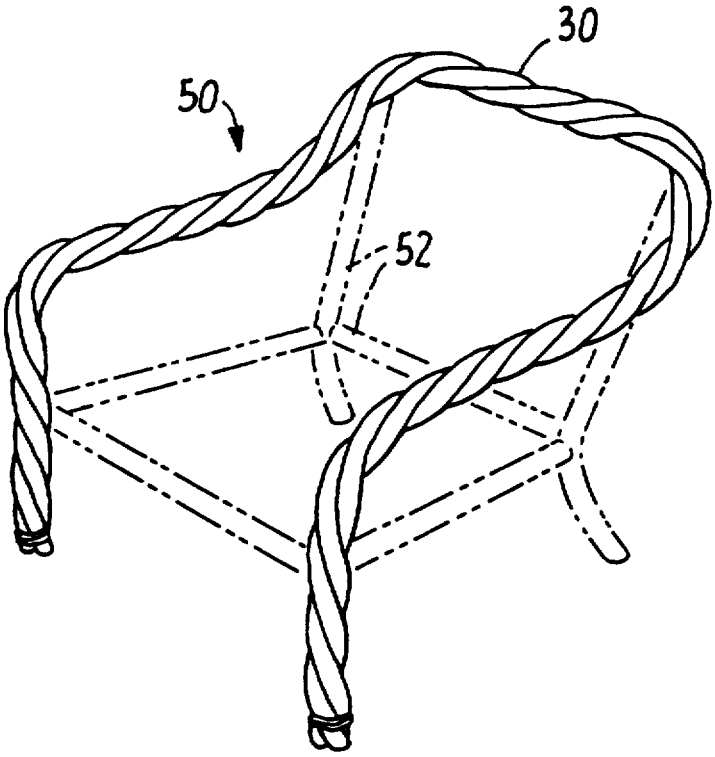

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-11 is confirmed.

New claims 12-20 are added and determined to be patentable.

*12. A method of fabricating a larger diameter piece of rattan from smaller diameter rattan segments comprising the steps of:*

*heating a plurality of smaller diameter rattan segments until each piece is deformable, each said segment having a diameter in the range of 0.5 to 1 inch;*

*twisting the rattan segments while said segments are so deformable in a manner to define a composite helical piece having a larger effective diameter than the individual segments, said effective diameter of said composite helical piece being in the range of 1.5 to 3 inches; and*

*cooling the larger diameter piece such that a rigid member is produced suitable for constructing furniture.*

*13. A method as recited in claim 12 wherein said composite helical piece is shaped in a curved configuration of a structural element for constructing furniture.*

*14. A method of fabricating a larger diameter piece of rattan from smaller diameter rattan segments comprising the steps of:*

*heating a plurality of smaller diameter rattan segments until each piece is deformable;*

*twisting the rattan segments while said segments are so deformable in a manner to define a composite helical piece having a larger effective diameter than the individual segments;*

*shaping the composite helical piece into a curved configuration of a structural element for constructing furniture; and*

*cooling the larger diameter piece such that a rigid member is produced suitable for constructing furniture.*

*15. A method as recited in claim 14 wherein said effective diameter of said composite helical piece is in the range of 1.5 to 3 inches.*

*16. A method as recited in claim 14 wherein the diameter of each of said rattan segments is in the range of 0.5 to 1 inch.*

*17. An improved method of assembling rattan furniture including the steps of:*

*providing a plurality of rattan segments, each having a diameter in the range of less than one inch to equal to or greater than one-half inch;*

*heating said rattan segments until each is deformable;*

*twisting the segments while the segments are so deformable in a manner to define a composite helical piece having an effective diameter greater than one and one-half inches;*

*bending and securing the composite helical piece into a desired curvature to define a structural element of the piece of furniture; and*

*cooling the composite helical piece such that a rigid structural member for the furniture is produced of the desired curvature.*

*18. A method as recited in claim 17 further comprising the step of, before said bending step, securing the ends of said composite helical piece to maintain the helical configuration of the segments relative to one another.*

*19. Improved furniture having elements formed from rattan, wherein the improvement comprises:*

*a composite rattan piece having an effective diameter greater than one and one-half inches, said composite piece being formed from a plurality of rattan segments, each having a diameter of less than one inch, with said rattan segments being twisted into a composite helical piece for added strength, said composite helical piece being shaped in a curved configuration and forming a structural element of said furniture.*

*20. Improved furniture as recited in claim 19 wherein each said rattan segment has a diameter of equal to or greater than one-half inch.*

* * * * *